US005246348A

United States Patent [19]

Wallace et al.

[11] Patent Number: 5,246,348

[45] Date of Patent: Sep. 21, 1993

[54] LIQUID RING VACUUM PUMP-COMPRESSOR WITH DOUBLE FUNCTION OF LIQUID RING WITH SEPARATE SOURCES

[75] Inventors: T. Michael Wallace; Charles H. Wunner, both of Charlotte, N.C.

[73] Assignee: Vooner Vacuum Pumps, Inc., Charlotte, N.C.

[21] Appl. No.: 882,820

[22] Filed: May 14, 1992

[51] Int. Cl.[5] ..... F04C 19/00

[52] U.S. Cl. ..... 417/68

[58] Field of Search ..... 417/68, 69

[56] References Cited

U.S. PATENT DOCUMENTS 1,904,321 4/1933 Nash ..... 417/68
4,392,783 7/1983 Jozepaitis ..... 417/68
4,747,752 5/1988 Somarakis ..... 417/68
5,100,300 3/1992 Haavik ..... 417/68

*Primary Examiner*—Edward K. Look
*Assistant Examiner*—Christopher Verdier
*Attorney, Agent, or Firm*—Ralph H. Dougherty

[57] ABSTRACT

An improved liquid ring vacuum pump apparatus and method for reducing wear between the cone and rotor vanes, by reducing the water flow contacting these parts, by injecting only fresh water into the seal segment while injecting secondary water into the pump through the housing. The apparatus includes dual water injectors, one injector at the periphery of the housing, and a second injector central within the housing, each of which is supplied by a different water source. A novel cone structure including grooves and notches for directing fluid to specific segments within the pump.

18 Claims, 4 Drawing Sheets

LIQUID RING VACUUM PUMP-COMPRESSOR WITH DOUBLE FUNCTION OF LIQUID RING WITH SEPARATE SOURCES

FIELD OF THE INVENTION

The present invention relates to liquid ring vacuum pumps or compressors, and more particularly to a method and a structure for extending the operating life of the pump while retaining the efficiency of pump operation throughout its operating life, and for reducing the amount of fresh water required in the operation of the pump. The invention is a liquid ring vacuum pump having dual sources of sealing liquid.

BACKGROUND OF THE INVENTION

Liquid ring vacuum pumps, as exemplified by Roe et al U.S. Pat. No. Re. 29,747, which is incorporated herein by reference, use "seal water" for two purposes, first to form a liquid ring of working pistons that compress the gas and push it out of the pump, and second to form a seal between high pressure gas being discharged and low pressure gas entering the pump. This seal is formed in the angular segment land area of the 360 degree cycle, where the liquid ring pistons contact the cone surface. As used herein, the land, or land area, of the cone shall mean that portion of the cone which is in closest communication with the working water pistons. The efficiency of the pump depends on the seal created by both the clearance of the metal surfaces of the rotor vanes and cone surface and the pistons contacting the cone land area.

Shaft packing rings in a "stuffing box" require water for both sealing and cooling. If secondary (or recycled) water is pumped into the liquid ring pump through the center of the cone, then fresh water is piped separately into the stuffing box to avoid erosion of the shaft.

Metal parts of a liquid ring pump, particularly the vane surface at the inner tapered diameter of vanes and the cone land area surface, become worn during operation, causing an opening of clearances and subsequent loss of efficiency. After an extended time in operation, costly replacement or repair of the worn parts is required to rebuild the pump in order for it to perform anywhere approaching its original efficiency. Using only clean fresh water with known liquid ring vacuum pumps will reduce the cause for repair of such pumps, but with ever increasing costs for use of fresh water, and sometimes limited fresh water availability, use of 100% fresh water has become expensive or prohibitive. Also, the pre-treatment/filtration equipment necessary to remove suspended particulates from the secondary plant water to produce water with the degree of cleanliness that would minimize the erosive wear is both costly to purchase and expensive to operate and maintain. Alternatively, using secondary plant water for sealing water contains erosive particulates as with the addition of inflow of non-separated process water, and will wear away the metal, both on the inner surface of the rotor vanes at the small diameter end of the tapered cone, and on the land area of the cone. This loss of metal weakens the liquid seal in the land area and causes an early loss of pump efficiency, thereby causing the need for costly pump repairs.

It is not recommended to use secondary plant water to seal and cool the shaft packing rings, since it contains particles that would be captured between the shaft and packing, and cause excessive wear of the shaft material.

Clean fresh water is piped separately to the stuffing box that holds the packing rings.

Prior pump patents deal with improvements in the gas flow and compression ratio in the pump to achieve higher vacuum. Little attention has been given to the prevention of wear in the pumps caused by the sealing liquid.

DESCRIPTION OF THE PRIOR ART

Applicants are aware of the following U.S. patents concerning liquid ring pumps:

| U.S. Pat. No. | Inventor | Title |
|---|---|---|
| 3,209,987 | Jennings | LIQUID RING PUMP |
| 3,743,443 | Jennings | VACUUM PUMP |
| Re. 29,747 | Roe et al. | LIQUID RING PUMP LOBE PURGE |
| 4,747,752 | Somarakis | SEALING AND DYNAMIC OPERATION OF A LIQUID RING PUMP |

Jennings U.S. Pat. No. 3,209,987 is exemplary of liquid ring pumps over which the present invention is an improvement.

Jennings U.S. Pat. No. 3,743,443 teaches a seal apparatus in a central groove between successive stages, and a deflector blade for cooling the packing gland.

Roe et al. U.S. Pat. No. Re. 29,747 teaches apparatus for purging or draining of contaminants from a liquid ring pump.

Somarakis U.S. Pat. No. 4,747,752 teaches apparatus for sealing the shaft and redirecting leakage toward a low pressure area.

SUMMARY OF THE INVENTION

The invention provides a pump apparatus having a structure which modifies the total flow of sealing liquid to a cone port vacuum pump while directing the sealing liquid to different segments around the cone surface. The structure includes closely spaced radial grooves across the smaller end of the cone over the land and compression segments, and advantageously one or more annular labyrinth grooves may be provided at the end or on the side of the cone, or both, over the inlet and discharge segments of the cone.

The method includes using double sources of sealing liquid, including introducing fresh water to seal the land area, while introducing secondary water (sometimes known as "white water") from the outside of the housing through the housing to act as the working piston.

During normal operation, clean fresh water flows through the cone to the land area, forming a liquid seal, while secondary water is introduced through the housing wall into the annular peripheral space near the interior of the housing wall to provide the water necessary to form the working piston of the pump.

The present invention solves the problem of rapid erosion of the inner tapered diameter of the vanes of the rotor and the cone land area. Two sources of water are used, fresh water to create the important seal layer over the land area of the cone, and secondary plant water to provide the working piston of the vacuum pump. By keeping the critical metal surfaces of the rotor vanes and cone land area in contact with fresh water, erosion is kept to a minimum.

The invention also solves the environmental and cost problem of using too much fresh water in the operation of a liquid ring vacuum pump. The fresh water requirement is limited to an amount sufficient to maintain a clean sealing liquid layer in contact with and between the metal vanes of the rotor and land area of the cone. Secondary plant water is used to form the working piston of the pump, thereby saving fresh water. The life of the metal parts is extended without wasting fresh water to form the liquid ring of working pistons.

In addition, the invention eliminates the problem of requiring a separate fresh water pipe connection to the stuffing box, as the reduced flow of fresh sealing water also passes toward the packing rings for sealing and cooling.

OBJECTS OF THE INVENTION

The principal object of the invention is to prolong the useful life of critical metal surfaces of rotor vanes and cone in the land area of the pump.

It is also an object of the invention to use fresh water to save critical metal parts but not waste fresh water to make working pistons.

Another object of the invention is to allow the use of less expensive secondary plant water to form the working piston of the pump without attacking the critical metal parts forming the seal of the land area.

Another object of the invention is to provide an improved means to minimize the total flow of sealing liquid to a cone port vacuum pump.

A further object of this invention is to provide a method to efficiently direct sealing liquid around the cone surface.

Another object of the invention is to prevent sealing liquid from passing over the discharge opening of the cone, and being immediately discharged and wasted without performing a function of either compression or sealing.

Another object of the invention is to seal and cool the packing rings with fresh water without a separate pipe connection to the outside of the stuffing box.

BRIEF DESCRIPTION OF THE DRAWINGS

The foregoing and other objects will become more readily apparent by referring to the following detailed description and the appended drawings in which.

DETAILED DESCRIPTION

Figure 2:
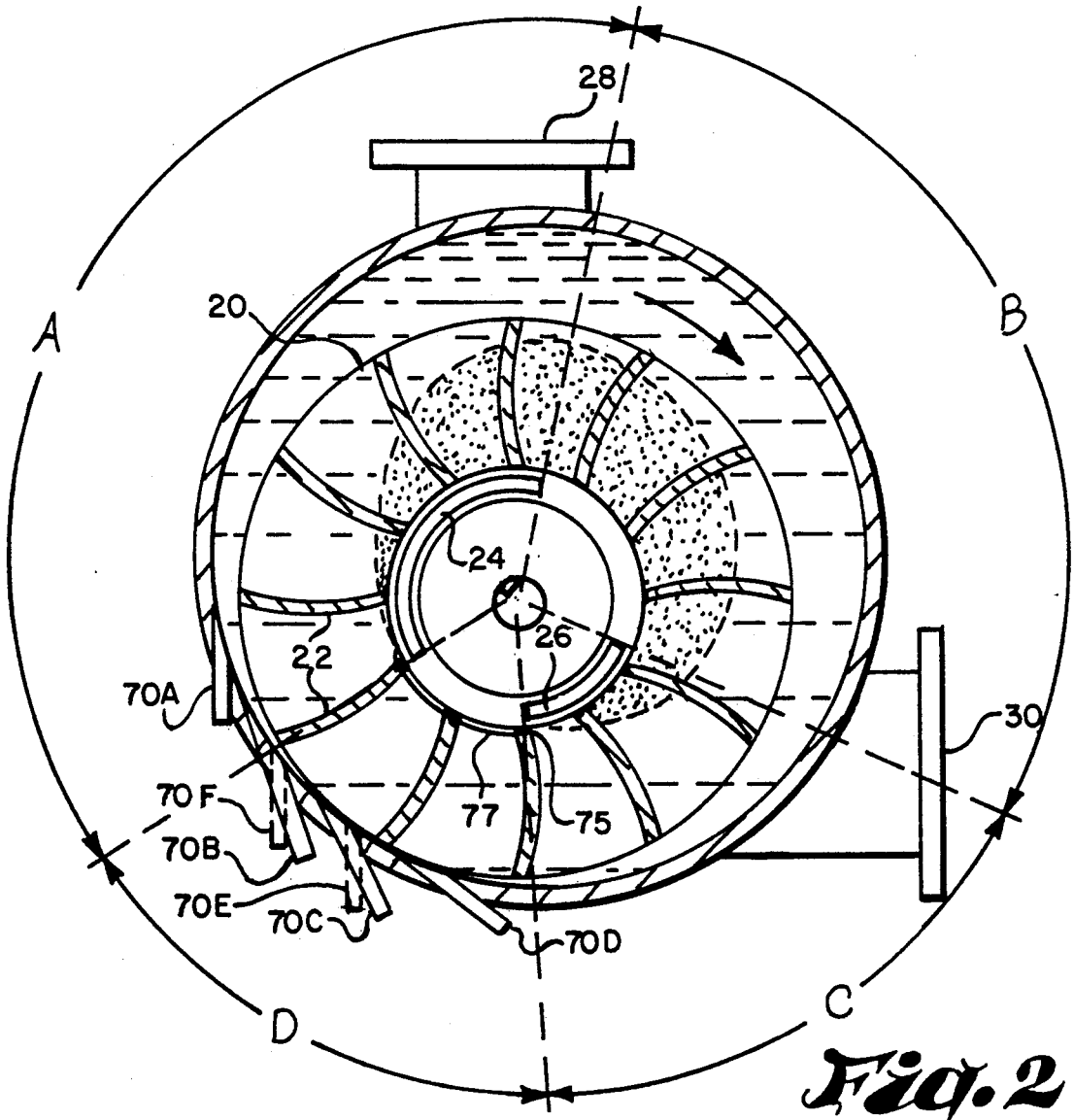
FIG. 2 is a schematic cross-section of the liquid ring pump.
Figure 3:
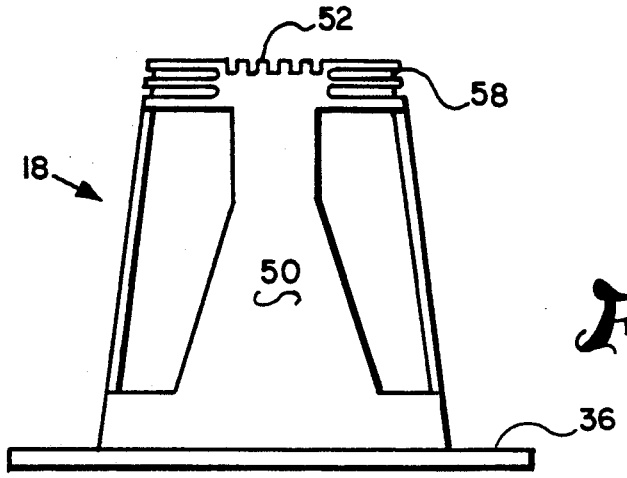
FIG. 3 is a front view of the cone member of FIG. 1.

The four stages of liquid ring pump operation, which take place about specific angular segments of the cone, as depicted in FIG. 2, are: the gas inlet or intake stage A, the gas compression stage B, the compressed gas discharge stage C, and the liquid seal stage D, the last of which occurs at the land area.

Figure 6:
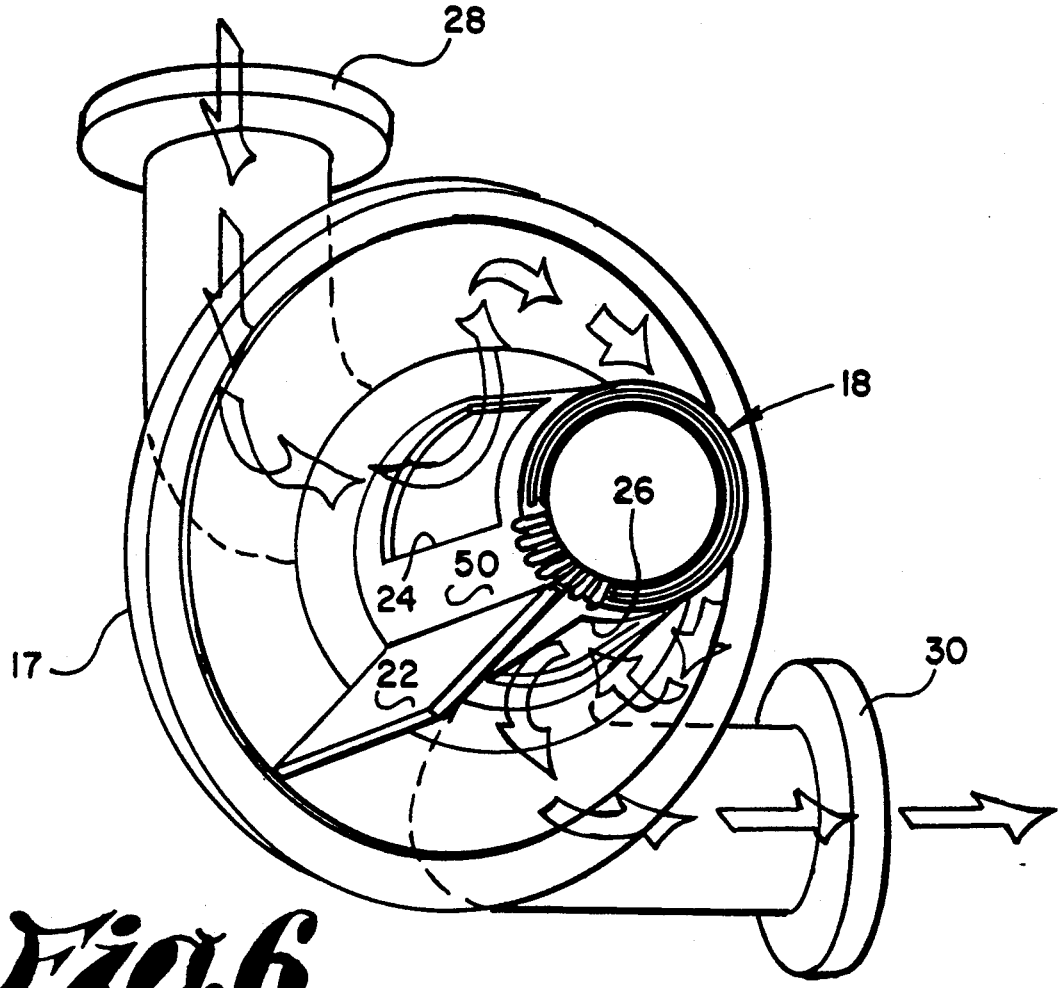
FIG. 6 is an isometric view of a port-containing cone member mounted on a head member showing the gas flow pattern.

Referring now to the drawings, the invented liquid ring pump 10 includes a shaft 12 connected to an associated drive means, such as motor 13, the shaft extending along a longitudinal axis through housing 14. The shaft is journalled for rotation in bearings 16. The shaft passes through the stuffing box, which is mounted in the head 17 in a position inside of the bearings. While the shaft is rotating within the stuffing box, water-cooled shaft packing provides a seal about the shaft to exclude atmospheric air from the vacuum chamber. A cone 18, which is actually the frustrum of a cone, is fixed within head 17, with the axis of the cone coextensive with the axis of shaft 12, the shaft passing through the cone. A rotor 20, having integral vanes or blades 22 mounted thereon, is fixed to the shaft, and rotates with the shaft relative but off-centered to the pump housing. Further, the shaft rotates within the cone while the rotor rotates about the cone. FIG. 6 shows the cone 18 mounted in head 17, and only a single vane 22 of the rotor for ease of understanding of the interior pump arrangement. A gas inlet port 24 and gas outlet port 26 are provided on opposite sides of the cone, as shown. Several different gas port configurations are depicted in the various figures. Gas inlet 24 communicates with housing gas inlet passageway 28 in the head 17, while gas outlet 26 communicates with housing gas outlet passageway 30 in the head 17. The gas flow pattern is clearly shown by the arrows in FIG. 6.

Figure 1:
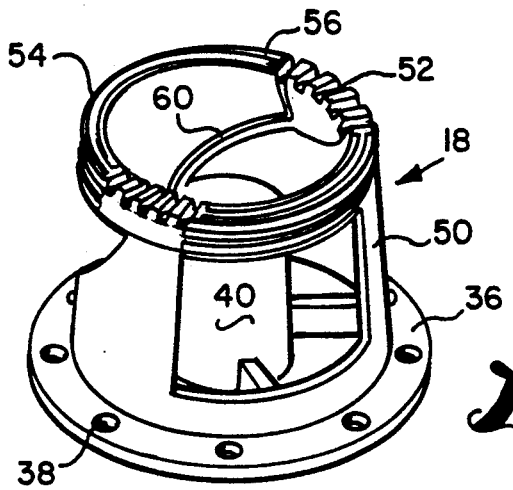
FIG. 1 is an isometric view of a port-containing cone member in accordance with the invention.

The cone has a generally annular base flange 36 with means for fixing the cone into place within the head 17, such as bolt holes 38. The central cylindrical portion 40 of the cone (as best seen in FIG. 1) is adapted to receive shaft 12. Fresh clean water is admitted to the central portion 40 about the shaft. The outer annular portion of the cone contains the gas ports, inlet port 24 for admitting gas, such as air to be compressed from passageway 28 and generally opposing outlet port 26 for ejecting compressed air therethrough to outlet passageway 30.

Between the end of the gas outlet port 26 and the beginning of the gas inlet port 24 is the area 50 of the cone known as the "land". It is important to provide a seal in the land area 50 between the two gas ports 24 and 26 to prevent the passage of gas through or over this region. This is accomplished by passing fresh clean water through and over the cone to provide a layer of clean water 77 between the two metal surfaces causing a liquid seal between the inlet and outlet ports of the cone. It is also important to prevent damage to the adjacent metal surfaces of the cone and the rotor in the land area from friction or from scoring by particulates contained in the water within the pump.

The cone 18 is provided with a series of radial notches 52 at the small end 54 or tip thereof. There are generally from one to about eight of such notches, which are closely spaced and located adjacent either the land or compression segments, but preferably both. The notches can have any desired cross-section, including triangular, rectangular, trapezoidal, round, or oval. Advantageously, the cone 18 is also provided with one or more annular labyrinth grooves 56 in the flat area, or face, of the cone end 54 between the areas of the notches 52, as shown. Either alternatively or in addition to grooves 56, one or more annular labyrinth grooves 58 may be provided on the side of the cone near the end 54 in the intake and discharge areas. A spiral groove or closed conduit 60 may be provided in the interior portion 40 of the cone, connecting fresh water inlet 62 with the radial notches 52. The annular and spiral grooves and/or conduit likewise can have any desired cross-section. The set of grooves and notches are generally machined into the cone, but may be formed in casting.

In operation, fresh seal water from water source 64 and conduit 65 enters the housing along the shaft. A minor portion of the fresh water flows to the stuffing box, while the major portion is introduced through notches 52 into the land and compression segments of the cone, and is restricted with labyrinth type seals from entering the other (gas intake and gas discharge) segments of the cone. The means to both direct and control the flow of the sealing water in combination with the means for addition or injection of piston water directly into the periphery of the housing comprise the essence of the invented apparatus.

The radial notches or grooves 52 in the land and compression segments of the cone 18 direct the flow of sealing water toward the land area and compression segments of the cone, and secondly, the circular labyrinth grooves 56 and 58 reduce the water flow velocity and thereby restrict the flow of the liquid from entering the inlet and discharge segments of the cone. These structural features concentrate the flow of seal water to the location where it is most needed, and restricts the flow over the segments through which gas flows in a radial direction between the cone and the surface of the working piston of liquid.

The operation of the liquid ring pump requires a substantial amount of water to remove the heat of compression generated by the pump, as the heated water exits with the compressed gas. Therefore make-up water is required. This necessary make-up water from source 68, which is cooler than the removed water, is introduced into the pump 10 directly through the wall of the housing 14. The makeup water can be injected at any convenient location 70 through the exterior of the housing. Six injection locations are shown in FIG. 2. While the makeup water can be injected directly, or radially, or at any angle incident to the direction of rotation, as indicated by water injection ports 70E and 70F, it is preferred that make-up water be injected tangentially as at port 70A, 70B, 70C, or 70D, in the same direction as the direction of rotation of the pump to avoid any extraneous water ejection along with the compressed gas. The optimum location for make-up water injection is 70D, opposite the land area.

The fresh water entering at the land area, by its pressure and centrifugal force, pushes the secondary water of the liquid piston ring away from contact with the critical metal surfaces of the rotor vane end 75 and cone in the land area 50, by forming a thin film 77 of clean fresh water.

In the liquid ring vacuum pump-compressor of the present invention, the total flow of liquid is reduced by that amount of sealing water which normally comes from the shaft over the end of the cone to be immediately discharged out the gas discharge port without performing any functions of compression or sealing.

ALTERNATIVE EMBODIMENTS

Alternatively, a closed conduit may be provided in place of spiral groove 60, connecting fresh water inlet 62 with radial notches 52. Further, a closed conduit can be provided along the shaft for delivering fresh water to the compression and seal areas.

Figure 9:
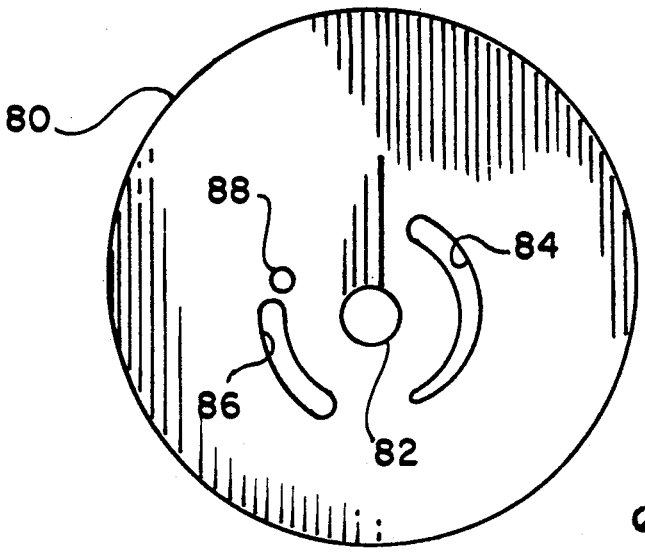
FIG. 9 is an elevation view of an alternative port-containing flat plate member for use in connection with the present invention.
Figure 8:
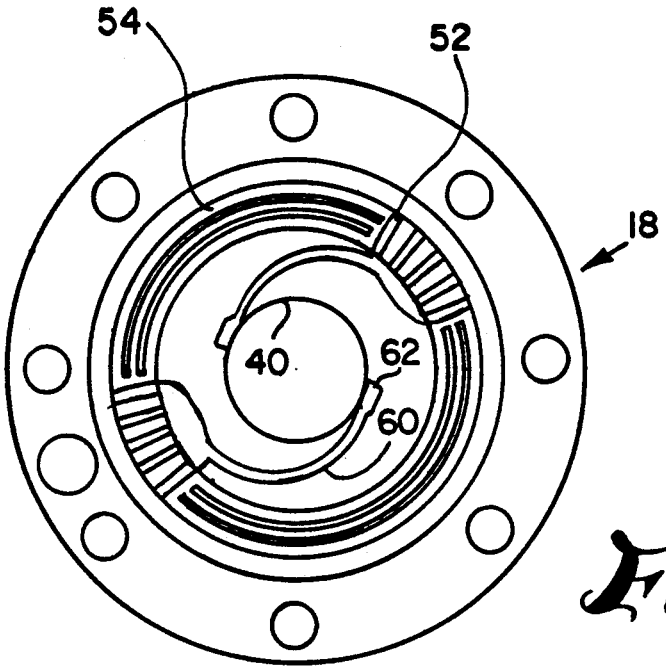
FIG. 8 is an end view of the port-containing cone member of the invention.
Figure 7:
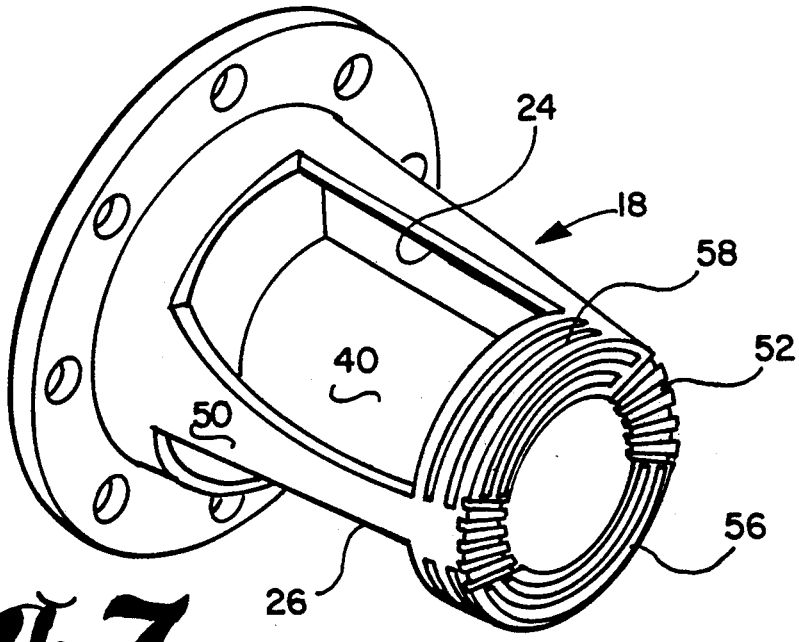
FIG. 7 is an isometric view of a port-containing cone member from a different perspective than FIG. 1.

The present invention is also advantageously adapted to a flat plate pump such as shown in Jozepaitis U.S. Pat. No. 4,392,783, and in FIG. 9. In this case, what has been referred to as the cone is actually a flat plate 80 with a shaft accommodating hole 82 therein. Clean water is admitted through the hole 82 along the shaft, gas is admitted through an intake 84 in the flat plate and compressed gas is ejected through outlets 86 and 88 in the flat plate. Such flat plate pump is generally used in the chemical industry for toxic gases.

The make-up or recycle water system is equally applicable to single lobe pumps, as shown, and to double lobe pumps as shown in U.S. Pat. No. 3,588,283.

Figure 4:
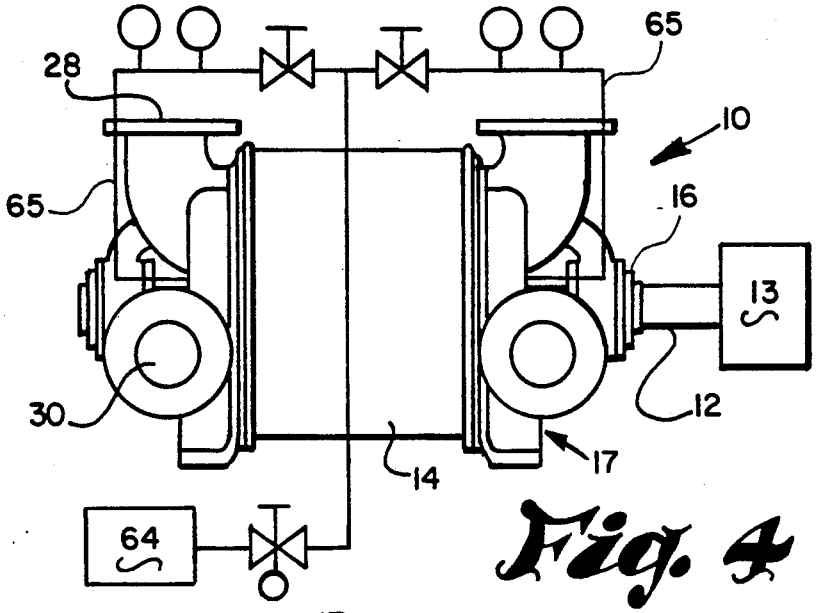
FIG. 4 is a front elevational view of a liquid ring pump showing a fresh seal water injection and control system schematically thereon.
Figure 5:
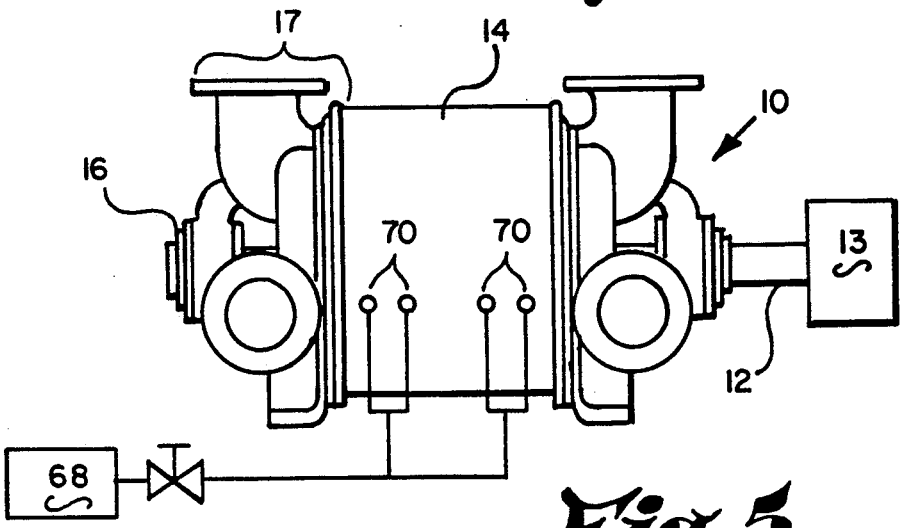
FIG. 5 is a rear elevational view of the liquid ring pump of FIG. 1, showing a schematic secondary working piston water injection and control system.

While FIGS. 4 and 5 depict a double-cone pump, the present invention is equally applicable to a single cone pump.

SUMMARY OF THE ACHIEVEMENT OF THE OBJECTS OF THE INVENTION

From the foregoing, it is readily apparent that we have invented an improved method and apparatus for efficiently directing sealing liquid to the different angular segments of the surface of a cone of a liquid ring vacuum pump, for preventing sealing liquid from passing over the discharge opening of the cone without performing a function of either compression or sealing, for preventing sealing liquid from passing over the inlet opening of the cone and consuming volume desired for inlet gas to occupy before performing a function of either compression or sealing, thereby minimizing the total flow of fresh sealing liquid to a cone port vacuum pump. The improved method and apparatus also allows the use of less expensive secondary plant water to form the working piston of the pump, and the sealing and cooling of packing rings with fresh water without a separate pipe connection to the outside of the stuffing box, resulting in a more economical vacuum pump operation than heretofore has been possible.

Furthermore the double source of sealing liquid attack of the critical metal parts such as inner surface of vanes and land area of cones by liquid passing over them is reduced to the small amount of fresh water sealing the land area and is not exposed to the liquid needed for makeup (entering the housing) as has heretofore been standard practice.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A liquid ring vacuum pump or compressor apparatus having sequentially an inlet segment, a compression segment, a discharge segment, and a seal segment, said apparatus comprising:

a generally annular housing having a longitudinal axis;

a rotor mounted for rotation within said housing, and having vanes extending generally radially therefrom, forming a plurality of working chambers;

a port-containing member comprising a cone through which a pumped medium is admitted to and discharged from said working chambers, said cone having a large base end and an opposite small end with an end face thereon; and means for introducing water from the interior of said cone to the exterior face of said cone, between said cone and the end of said vanes adjacent said cone, around the small end of said cone to the seal segment;

said cone being provided with at least one radial notch at the small end of the cone for directing water from the interior of the cone over the small end of the cone to the seal segment of the cone; and means for introducing water directly into the interior of said chamber through said housing.

2. Apparatus according to claim 1, wherein said means for introducing water through said housing has an injection connection oriented generally tangential to the housing in the direction of rotation of the rotor.

3. Apparatus according to claim 1, further comprising a source of fresh water communicating with said means for introducing water from the interior of said cone to the exterior of said cone around the small end of said cone.

4. A liquid ring vacuum pump or compressor apparatus having sequentially an inlet segment, a compression segment, a discharge segment, and a seal segment, said apparatus comprising:

a generally annular housing having a longitudinal axis;

a rotor mounted for rotation within said housing, and having vanes extending generally radially therefrom, forming a plurality of working chambers;

a port-containing member comprising a cone through which a pumped medium is admitted to and discharged from said working chambers, said cone having a large base end and an opposite small end with an end face thereon;

means for introducing water from the interior of said cone to the exterior face of said cone, between said cone and the end of said vanes adjacent said cone, around the small end of said cone to said chambers;

said cone being provided with at least one radial notch at the small end of the cone for directing water from the interior of the cone over the end of the cone to the compression segment; and means for introducing water directly into the interior of said chamber through said housing.

5. Apparatus according to claim 4, wherein said means for introducing water through said housing has an injection connection oriented generally tangential to the housing in the direction of rotation of the rotor.

6. Apparatus according to claim 4, further comprising a source of fresh water communicating with said means for introducing water from the interior of said cone to the exterior of said cone around the small end of said cone.

7. A liquid ring vacuum pump or compressor apparatus having sequentially an inlet segment, a compression segment, a discharge segment, and a seal segment, said apparatus comprising:

a generally annular housing having a longitudinal axis;

a rotor mounted for rotation within said housing, and having vanes extending generally radially therefrom, forming a plurality of working chambers;

a port-containing member comprising a cone through which a pumped medium is admitted to and discharged from said working chambers, said cone having a large base end and an opposite small end with an end face thereon; and means for introducing water from the interior of said cone to the exterior face of said cone, between said cone and the end of said vanes adjacent said cone, around the small end of said cone to the seal segment;

said cone being provided with a plurality of closely spaced notches at the small end of the cone for directing water from the interior of the cone over the seal segment of the cone; and means for introducing water directly into the interior of said chamber through said housing.

8. Apparatus according to claim 7, wherein said means for introducing water through said housing has an injection connection oriented generally tangential to the housing in the direction of rotation of the rotor.

9. Apparatus according to claim 7, further comprising a source of fresh water communicating with said means for introducing water from the interior of said cone to the exterior of said cone around the small end of said cone.

10. A liquid ring vacuum pump or compressor apparatus having sequentially an inlet segment, a compression segment, a discharge segment, and a seal segment, said apparatus comprising:

a generally annular housing having a longitudinal axis;

a rotor mounted for rotation within said housing, and having vanes extending generally radially therefrom, forming a plurality of working chambers, a port-containing member comprising a cone through which a pumped medium is admitted to and discharged from said working chambers, said cone having a large base end and an opposite small end with an end face thereon; and means for introducing water from the interior of said cone to the exterior face of said cone, between said cone and the end of said vanes adjacent said cone, around the small end of said cone to said chambers;

said cone being also provided with at least one annular labyrinth groove in the end face of the cone for restricting water flow around the cone and from entering the inlet and discharge segments; and means for introducing water directly into the interior of said chamber through said housing.

11. Apparatus according to claim 10, wherein said means for introducing water through said housing has an injection connection oriented generally tangential to the housing in the direction of rotation of the rotor.

12. Apparatus according to claim 10, further comprising a source of fresh water communicating with said means for introducing water from the interior of said cone to the exterior of said cone around the small end of said cone.

13. A liquid ring vacuum pump or compressor apparatus having sequentially an inlet segment, a compression segment, a discharge segment, and a seal segment, said apparatus comprising:

a generally annular housing having a longitudinal axis;

a rotor mounted for rotation within said housing, and having vanes extending generally radially therefrom, forming a plurality of working chambers;

a port-containing member comprising a cone through which a pumped medium is admitted to and discharged from said working chambers, said cone having a large base end and an opposite small end with an end face thereon; and means for introducing water from the interior of said cone to the exterior face of said cone, between said cone and the end of said vanes adjacent said cone, around the small end of said cone to said chambers;

said cone being provided with at least one annular labyrinth groove in the side of the cone adjacent the cone end for restricting water flow around the cone and from entering the inlet and discharge segments; and means for introducing water directly into the interior of said chamber through said housing.

14. Apparatus according to claim 13, wherein said means for introducing water through said housing has an injection connection oriented generally tangential to the housing in the direction of rotation of the rotor.

15. Apparatus according to claim 13, further comprising a source of fresh water communicating with said means for introducing water from the interior of said cone to the exterior of said cone around the small end of said cone.

16. A liquid ring vacuum pump or compressor apparatus having sequentially an inlet segment, a compression segment, a discharge segment, and a seal segment, said apparatus comprising:

a generally annular housing having a longitudinal axis;

a rotor mounted for rotation within said housing, and having vanes extending generally radially therefrom, forming a plurality of working chambers;

a port-containing member comprising a cone through which a pumped medium is admitted to and discharged from said working chambers, said cone having a large base end and an opposite small end with an end face thereon; and means for introducing water from the interior of said cone to the exterior face of said cone, between said cone and the end of said vanes adjacent said cone, around the small end of said cone to said chambers, said means for introducing water from the interior of said cone to the exterior of said cone around the small end of said cone includes at least one spiral groove communicating with the source of water and the cone end; and means for introducing water directly into the interior of said chamber through said housing.

17. Apparatus according to claim 16, wherein said means for introducing water through said housing has an injection connection oriented generally tangential to the housing in the direction of rotation of the rotor.

18. Apparatus according to claim 16, further comprising a source of fresh water communicating with said means for introducing water from the interior of said cone to the exterior of said cone around the small end of said cone.

* * * * *